United States Patent [19]

Jarvis

[11] 4,056,276

[45] Nov. 1, 1977

[54] DOOR LOCK

[76] Inventor: Kenneth W. Jarvis, 5900 Columbus Ave. South, Minneapolis, Minn. 55417

[21] Appl. No.: 673,403

[22] Filed: Apr. 5, 1976

[51] Int. Cl.[2] ..... E05C 3/16

[52] U.S. Cl. ..... 292/201; 292/117; 292/198; 292/216; 292/DIG. 49; 292/127; 292/227

[58] Field of Search ..... 292/216, 201, 198, 127, 292/117, 220, 227, DIG. 49, DIG. 71, DIG. 69

[56] References Cited

U.S. PATENT DOCUMENTS

| | | | |
|---|---|---|---|
| 1,184,498 | 5/1916 | Wells | 292/220 |
| 1,937,978 | 12/1933 | Miller | 292/127 |
| 2,325,225 | 7/1943 | Burke | 292/201 X |
| 2,767,007 | 10/1956 | Burke | 292/216 |
| 2,833,578 | 5/1958 | Burke | 292/216 X |
| 3,065,986 | 11/1962 | Barker | 292/198 X |

*Primary Examiner*—Robert L. Wolfe

*Attorney, Agent, or Firm*—Dugger, Johnson & Westman

[57] ABSTRACT

A door lock device suitable for operation with electrically operated means, which in turn can be actuated by magnetic card, special turn key, or a key punch combination for security purposes. If desired the lock device may be operated with a suitable mechanical or key lock mechanism. The door lock comprises a pivoting latch dog or bolt which is triggered to a locked position upon closing of a door. The pivoting dog or bolt is controlled by a toggle linkage which can be positioned near, on, or over-center to hold the door positively locked against external pressure. Means are provided for releasing the toggle linkage, even under loads against the door, by force directly applied to the toggle linkage between the end pivots of the linkage, and in addition springs are provided for moving the latch dog to an open position positively once the toggle linkage has been released. As the linkage is released the latch bolt moves the door to an ajar position.

14 Claims, 12 Drawing Figures

DOOR LOCK

BACKGROUND OF THE INVENTION

1. Field of the Invention

The present invention relates to door locks, and in particular to operating mechanisms for door latch bolts which provide positive reliable operation.

2. Prior Art

In the prior art various patents have advanced different types of door locks and latches. A pivoting latch dog for a door lock is shown in U.S. Pat. No. 307,281. However, the door lock does not provide means for preventing forcible entry nor is it electrically operated. The patent to Wells, U.S. Pat. No. 1,184,498 shows a toggle linkage actuated pivoting bolt, but the mechanism illustrated and described does not suit itself well for security necessary at the present time, nor does the linkage suggest any way that would permit operation through electrically actuated means. Another type of pivoting door bolt or latch dog is shown in U.S. Pat. No. 1,435,971. The lock is manually operated by a pivoting lever, in this particular instance, and it appears to applicant that the door must be pushed, after the lock is released, in order for the door to open. In other words, the door is not positively opened by actuation of the lock dog.

A type of silent door latch is shown in U.S. Pat. No. 2,848,263, issued to R. G. Miller, and a linkage is provided to exert a spring pressure against the door in a closed position to eliminate rattles and the like in this particular patent. Similarly, U. S. Pat. No. 3,667,793 shows a rotatable latch dog or cam that is operated through a sliding member, and which rotates to hold the door as the door is closed.

The patent to Leonard et al., U.S. Pat. No. 1,269,467 shows a pivoting latch for a refrigerator door that has a spring load tending to impel the door to open position when the latch is released.

Other patents that include linkage for operation of locks include the Pearce U.S. Pat. No. 2,189,992 showing an automobile door lock; U.S. Pat. No. 1,670,793 to Schrader which shows a snap closure fastener having a manually actuable handle; the U.S. Pat. to Miller No. 1,937,978 also showing a latch for a refrigerator door that has a spring loaded, manually actuated linkage; U.S. Pat. No. 2,016,519 to Schmidt which shows a door latch that also is spring loaded and manually operated; U.S. Pat. No. 2,867,465 issued to Van Noord showing a latch control mechanism that insures that a door such as a refrigerator door is drawn tightly shut when it is closed; U.S. Pat. No. 2,833,578 issued to Burke, shows another type of refrigerator door latch using a snap action closure latch dog; and U.S. Pat. No. 2,650,846 to Allen which shows a latch for a vehicle door using a complex manually operated linkage.

SUMMARY OF THE INVENTION

The present invention relates to a door lock using a pivoting latch bolt mounted in a housing which can be installed into existing door jambs, and which will engage a door, pivot to a latched position, and will be held in this latched position by a toggle linkage so that the door cannot be opened by force on the door.

The toggle linkage is released to release the door latch bolt through the use of electrically or mechanically actuated means. In the form shown a solenoid that positively moves portions of the linkage by direct mechanical action to release the linkage is used. When the linkage is released from its locked position strong springs snap the door bolt to an open position and at the same time move the door ajar. A lost motion stop which insures that the provided operator must be actuated before the lock will release also is disclosed.

Different forms of release mechanisms are provided, but in each the mechanism is operated by linear movement of a solenoid armature that will in turn act to positively move a portion of the toggle linkage without depending on sliding cam movements or the like. The solenoid can be operated through suitable electronic controls, such as a series of punch keys that must be punched in a particular sequence for operation; magnetic cards, or other similar sensors. The solenoid can be operated with a manual switch for remote actuation of the door. Complete mechanical operation is also contemplated.

The lock housing can be made theft proof, and the door bolt can include hardened portions that resist hack sawing, to make the door substantially secure when the latch is latched.

The unit is simple to install, and by proper adjustment can be made to be used with a wide variety of individual door configurations without any substantial external modification on either the door or the door jamb.

DESCRIPTION OF THE PREFERRED EMBODIMENTS

Figure 1:
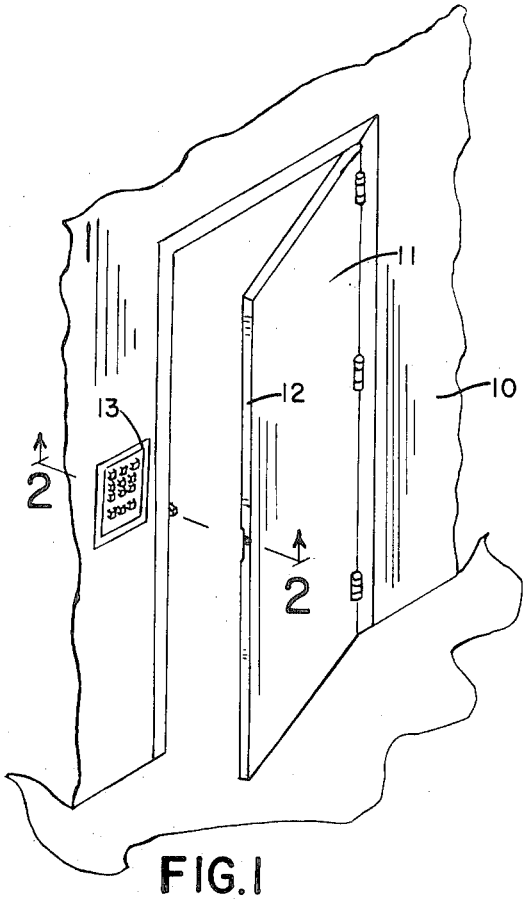
FIG. 1 is a fragmentary perspective view of a typical door assembly having a lock made according to the present invention installed thereon.

Referring to FIGS. 1 through 5, a first form of the invention, a building wall 10, as shown has a door 11 hingedly mounted in a door frame in the normal manner. A latch assembly is mounted into the wall 10, adjacent the latch edge 12 of the door as shown in FIGS. 2 through 5.

The latch assembly is designed to be electrically por mechanically operated. For electrical operation a control panel 13 may be used for operating the latch assembly. Such a control panel can be a combination device with keys that must be punched in a particular sequence before electrical power will be sent to the operator to operate the latch. The panel is shown schematically at 13 without any details because the mechanical portions of the latch are presented in this application. In addition to a control such as that shown at 13, normal turn keys operating switches, magnetic cards, or other suitable card sensors could be used for controlling the electrical power to the latch. Manual switch controls directly controlling power could also be used; likewise an all mechanical operator can be used.

Referring now to FIGS. 2 through 5 in detail, the latch assembly illustrated generally at 15 is mounted in a tubular metal housing 16 that is fitted within a receptacle or opening indicated at 17 defined within the wall 10, adjacent the latching edge 12 of the door. As can be seen, the housing 16 extends through the door jamb 20, and may be fixed in position in a suitable manner. The housing 16 can be held in place with screws or pins, or in other desired ways.

The latch assembly 15 as shown is made into a round unit so that it can be installed in existing door jambs with ordinary boring equipment. The housing can be rectangular in cross section, or can have any desired irregular cross-sectional shape.

Figure 4:
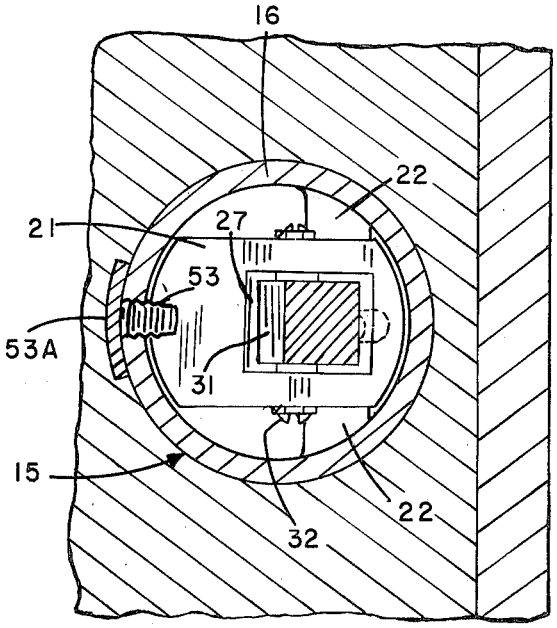
FIG. 4 is a sectional view taken as on line 4—4 in FIG. 2.

The latch assembly includes a latch bolt or dog 21 that is pivotally mounted on a pivot pin 22 that in turn is fixed to the housing 16. The pivot pin 22 extends through the latch bolt from the upper side to the lower side of the housing 16, as shown in FIG. 4. The latch bolt as shown has rounded edge surfaces that conform to the interior surface of the housing 16 and includes an actuator tang (FIGS. 2 and 3) that protrudes past the edge of the door jamb into the opening into which the door closes, and as can be seen, a recess 24 is defined in the edge portion of the lock member facing the door when in unlatched position.

The latch bolt 21 includes a locking finger portion 25 spaced from the tang 23 by recess 24, and positioned so that the outer tip of this finger portion 25 is at least flush with or slightly inward from the surface of the door jamb 20 when the latch housing is in place in the wall 10. The edge portion of the door 11 adjacent its edge 12 has a recess 26 that will receive the finger portion 25, as the latch dog 21 moves to its latched position. The recess 26 in the door may be formed by a metal insert in the door, if desired.

Figure 2:
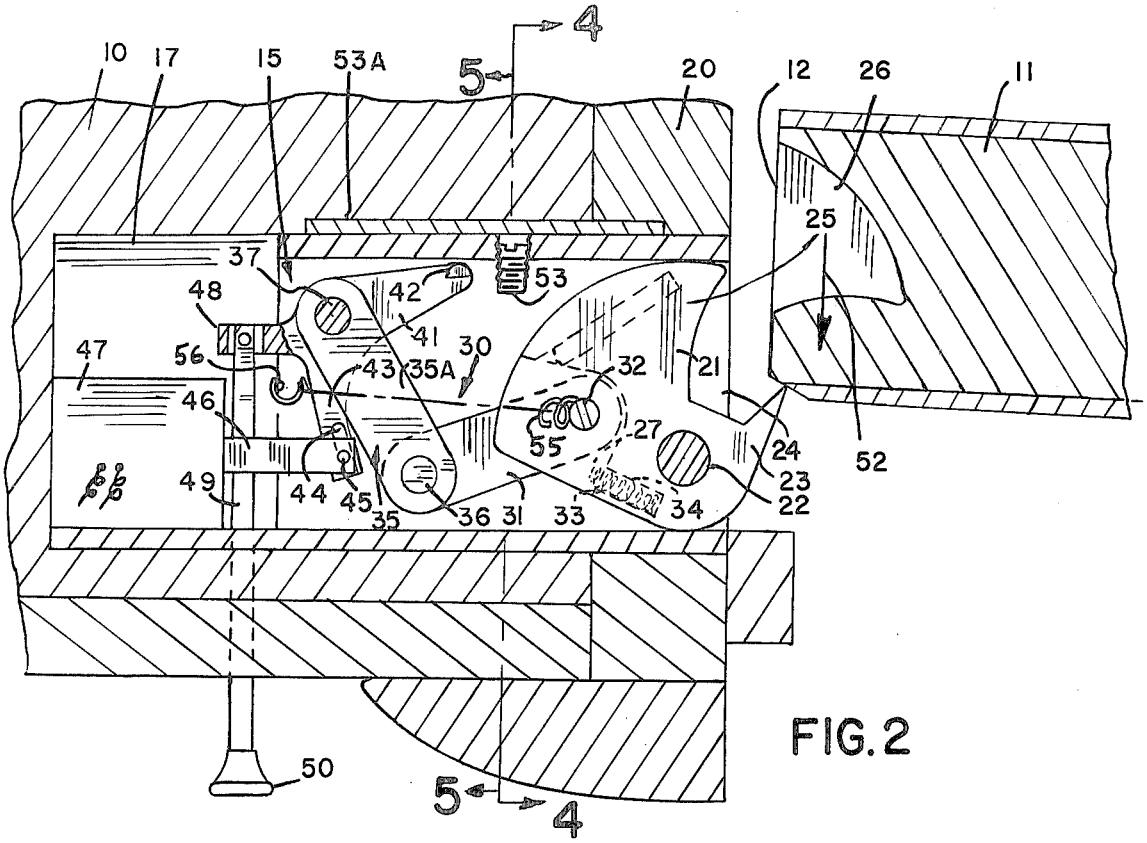
FIG. 2 is a sectional view taken as on line 2—2 in FIG. 1.
Figure 3:
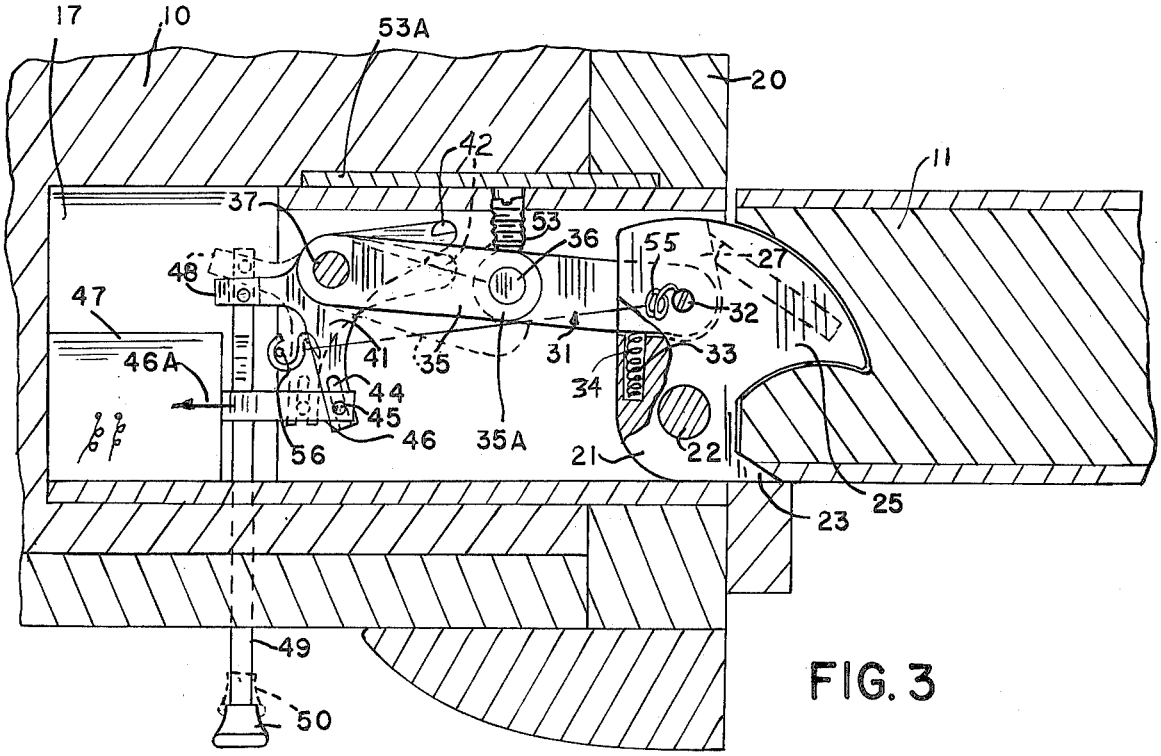
FIG. 3 is a sectional view taken on substantially the same line as FIG. 2 with the door in a latched position.

The latch dog 21 is of substantial vertical depth and has a recess 27 defined in the back side thereof, as shown in dotted lines in FIGS. 2 and 3, and as shown in FIG. 4. The latch bolt 21 is actuated through an over-center type toggle linkage indicated generally at 30 (FIGS. 2 and 3). The toggle linkage includes a first link member 31 that is pivotally mounted onto a pin 32 that passes through the latch dog from the upper to lower sides thereof, as shown in FIG. 4, and the pin 32 pivotally mounts the one end of the link 31 within the recess 27.

The link 31 is a solid bar as shown. A compression spring 33 is counted within a spring pocket or recess 34 defined in the latch dog. The spring aligns with link 31 and extends into the recess 27 to engage and resiliently bear on the link 31 when the latch closes, as will be more fully explained. A second link member assembly 35, made up of legs 35A and 35B, is pivotally mounted to the opposite end of the link member 31 from pin 32 with a pivot pin 36. The link 31 is positioned between the individual legs 35A and 35B of the link assembly 35. The opposite ends of the legs 35A and 35B are pivotally mounted to a pivot pin 37 that in turn is fixed with respect to the housing 16. The legs 35A and 35B can be held in position on the pin 37 relative to the housing side walls through the use of spacers or collars 40. An actuator bell crank 41 is positioned between legs 35A and 35B and is also pivoted on pin 37.

Figure 5:
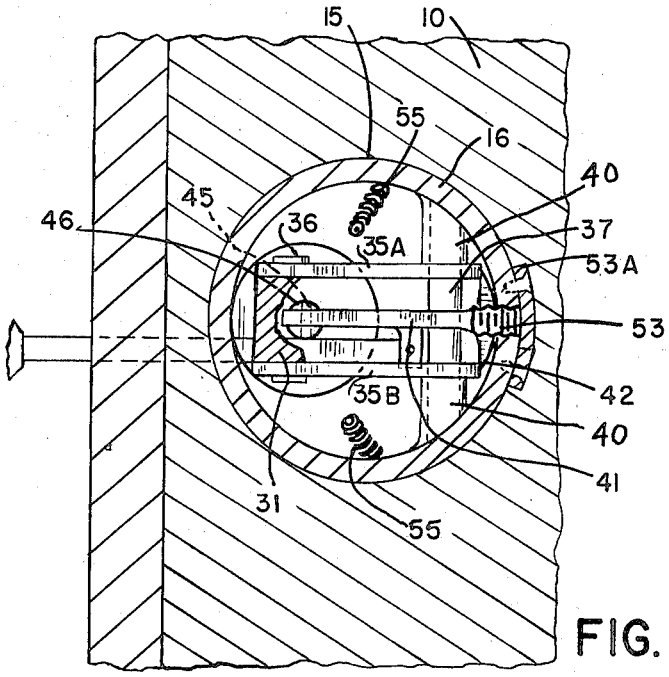
FIG. 5 is a sectional view taken as on line 5—5 in FIG. 2.

Bell crank 41 has ears 42 on the control leg of the bell crank that extend laterally outwardly sufficiently far on each side of the bell crank to overlie the upper edges of the legs 35A and 35B, as can perhaps best be seen in FIGS. 2 and 5. An actuator leg 43 of the bell crank has a slot 44 that receives a pin 45 that connects the slot 44 to the armature 46 of a solenoid 47 that is used for electrical operation. The armature 46 is spring loaded to an extended position as shown in FIG. 2. In addition, a connector lug 48 on the bell crank may have a manual push-pull link 49 connected thereto. A knob 50 on the link 49 on the interior of the wall 10 is used for manual operation of the bell crank, and therefore the latch, as will be more fully explained.

A stop screw 53 is threadably mounted through a provided opening in the side wall of the housing 16, and can be adjusted in and out with a screwdriver to provide a stop that will engage the link 31 adjacent the pin 36, that is, adjacent the pivot axis between the two links 31 and 35 forming the toggle linkage. The screw 53 is used for positively locating the position of the center axis of pin 36. A security plate 53A, hardened to prevent drilling, can be placed over the access hole to screw 53, if desired.

A pair of tension springs 55 are mounted to opposite ends of the pin 32, and are also attached in a suitable manner as shown at 56 to the rear edge of the main portion of the housing 16 to provide a force on the latch bolt 21 tending to rotate the latch bolt 21 counterclockwise about pivot pin 22 to a retracted position as shown in FIG. 2 when the links have been moved to unlocked position. As can be seen in FIG. 3, the adjustment screw 53 can be set to permit the links to go near center and even over-center, for positive locking. The term "on center" or "near center" refers to the position of the axis of pin 36 relative to a reference plane defined by the axes of pins 32 and 37. "On center" means the axis of pin 36 is lying on this plane. "Over-center" means the pin 36 has gone past the reference plane from its folded position. The links are stopped so that any load on the door tending to rotate the latch bolt will not permit opening the latch regardless of how much load is applied. When the solenoid 47 is energized, the armature 46 will be pulled in direction as indicated by the arrow 46A in FIG. 3, to pull the actuator leg 43 of the bell crank 41 to its dotted line position in FIG. 3, and the ears 42 will then bear against both the legs 35A and 35B to tend to pivot them to their dotted line position. The direct force on the link 35 pulls the pin 36 (and the links) to a release position. As soon as the links have moved so the axis of pin 36 is spaced from the plane defined by the axes of pins 32 and 37 a sufficient distance, the springs 55 will pivot the latch bolt to its full release position and fold the links to a position shown in FIG. 2. At the same time, the tang portion 23 of the latch bolt will push the door 11 to an ajar or partially open position as shown in FIG. 2.

When the door is to be closed, it will be moved in direction as indicated by the arrow 52 against the tang portion 23, pivoting the latch bolt about pin 22, and pulling the links 31 and 35 toward an on-center position so that the pin 36 will move up toward the stop screw 53. The links can be stopped in any desired location, for example as shown the axis of pin 36 may be stopped just short of dead-center (that is slightly spaced from the plane defined by the axes of pins 32 and 37) and the spring 33 will be compressed as the latch closes to exert a force tending to hold the links up against the stop even though they do not reach a dead-center position. If the spring 33 is selected to be of proper strength and size in relation to the position of the links and the force from springs 55, it will resist any tendency of the pin 36 and the links 31 and 35 to move away from the stop 53 from a opening force on the door and latch bolt 21, because of the low lever arm through which opening force from the door and bolt tending to cause folding (release) of the links acts when the links are close to an on-center position. The force from spring 33 and the increasing friction on the pivot pins 32, 36 and 37 will prevent the latch bolt from being pivoted to its open position under external forces.

The bell crank ears 42 provide positive movement of the midportions of the links without depending upon sliding can movement for releasing the lever. A definite mechanical travel of a pivoting member operated through a linearly moving solenoid armature 46 provides sufficient movement to pull the links 31 and 35 sufficiently from locked position for release. A positive opening action is provided even with loads on the door latch bolt such as from a warped door. The mechanical push-pull link 49 also operates through the same pivoting bell crank to provide the necessary motion for pulling the toggle links toward an open position. Whether the toggle links are not quite on center, are on center or are over center, the motion of the bell crank will pull the links from the center position sufficiently to release. Force of the spring 33 that tends to urge the links toward their center position will be easily overcome.

Referring now to FIG. 6, 7, 8 and 9, the wall 10 has a lock or latch assembly 60 mounted therein to latch a door 61. In this form of the invention, the latch assembly includes an outer housing 62 that can be fastened into the wall 10 in any desired manner. The housing extends through the door jam 20 as in the previous form of the invention. A door stop 63 is recessed as can be seen, to accommodate portions of the latch, and a slightly different means of operation is included.

A latch bolt 64 is pivotally mounted on a pin 65 fixed in the housing 62, and secured in place. The latch bolt 64 has an actuating tang 66, and a recess 67 defined therein to provide a latching finger 68 that is separated from the tang 66 and is shaped to enter into and be received in a complementary receptacle shape 69 defined in the edge portion of the door 61. The tang 66 has a projection 66A that fits into the complementary shaped recess in the door stop 63.

The latch bolt also may have a hardened steel pin inserted into it as shown in dotted line outline, to prevent gaining entry by sawing through the latch bolt.

Figure 8:
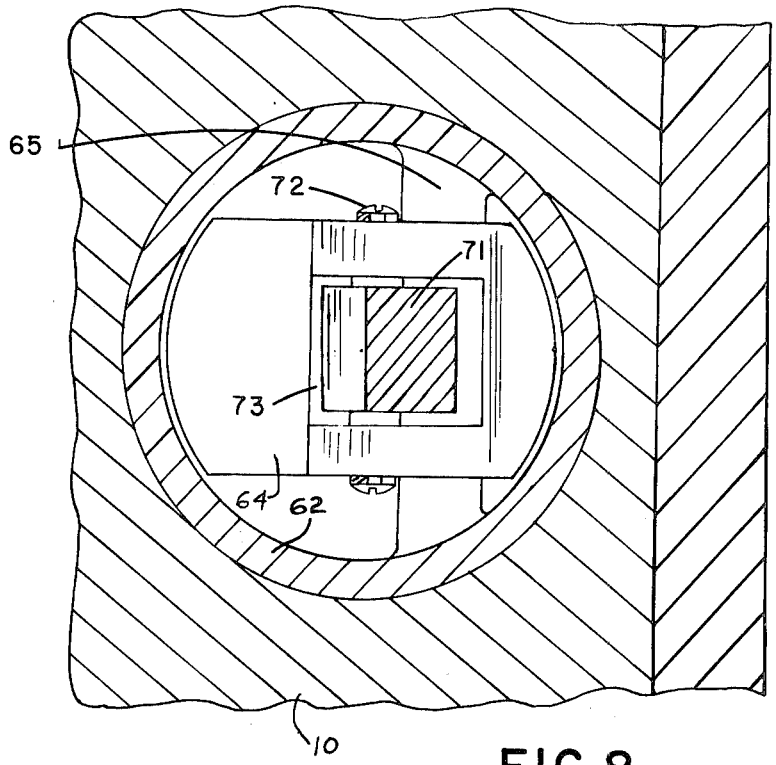
FIG. 8 is a sectional view taken as on line 8—8 in FIG. 6.

The pivoting of the latch bolt 64 in this form of the invention also is controlled through the use of a toggle linkage illustrated generally at 70, including a first link 71 comprising a solid link (see FIG. 8). The link 71 is pivoted at one end on a pivot pin 72 that is mounted in the latch bolt 64. The latch bolt 64 has a receptacle 73 therein (FIG. 8) that receives the end of the link 71.

A pair of springs 74 are connected between the opposite ends of pin 72, and suitable attachment members 75 on the interior of the housing 62 to exert a force tending to pivot the latch bolt open.

A second link assembly 76 comprising spaced legs 76A and 76B is pivotally mounted to the end of the link 71 opposite from latch bolt 64 with a pin 77. The link 71 is positioned between the legs 76A and 76B. The opposite ends of the legs 76A and 76B are mounted about a common pivot axis on a pin 78 that is fixed to the housing 62. The legs 76A and 76B are spaced from the housing walls with spacers 79 on the pin 78.

It can thus be seen that the toggle linkage 70 includes links pivoted on pins 78, 77 and 72. The links can move from a position shown in FIG. 6 wherein the latch bolt 62 is in a retracted position with the finger 68 recessed into the door jam 20 to a locked position generally as shown in FIG. 7.

The control of the toggle linkage is through a solenoid actuator 83 that is mounted in housing 62 and is fixed with respect thereto. The armature 84 of the solenoid extends therefrom. The armature is linearly moved when the solenoid is actuated, and it is spring loaded to an extended position so that when power to the solenoid is turned off, the armature will move to its ready position. A suitable manual switch 85 can be used for controlling the solenoid. The outer end of the armature 84 is bifurcated. The end of the armature 84 has a cross piece 91 extended laterally thereto, and lateral side arms 92 extending from the cross piece, parallel to the armature but spaced apart.

Figure 6:
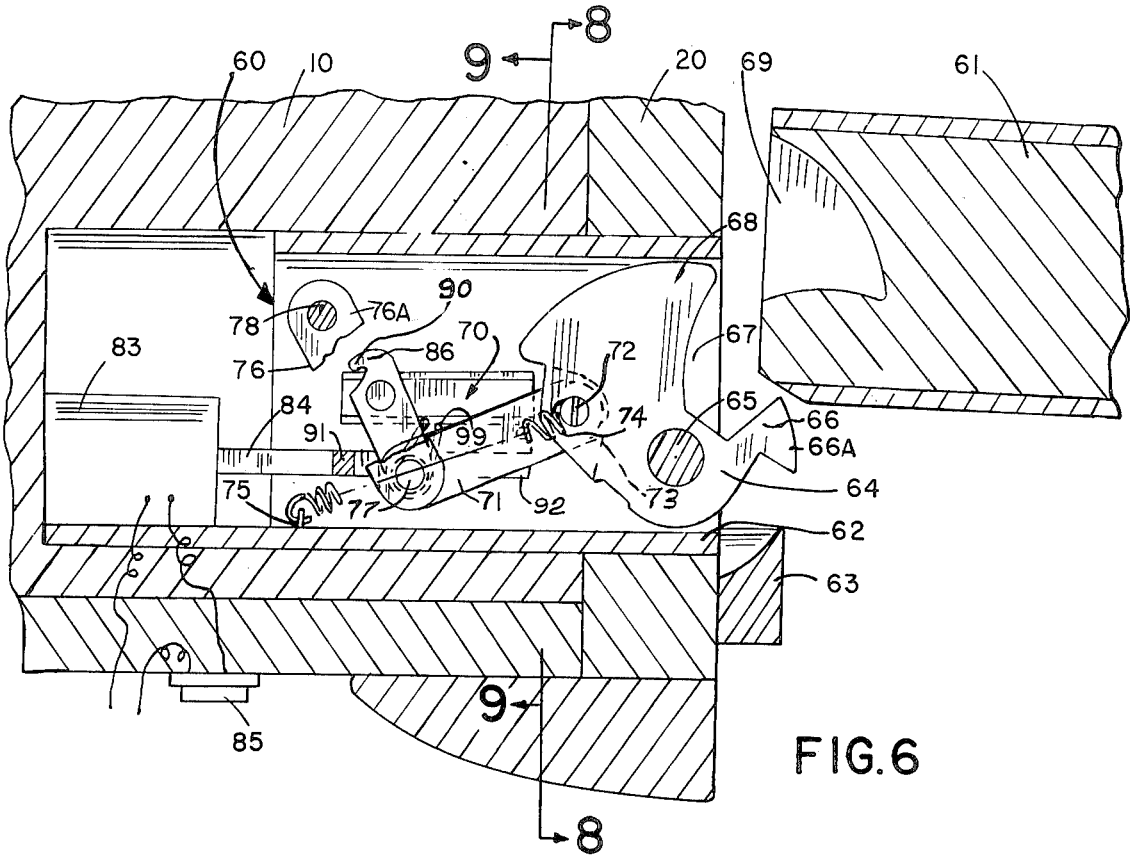
FIG. 6 is a view taken generally along the same line as FIG. 2, but showing a modified latch mechanism made according to the present invention.
Figure 9:
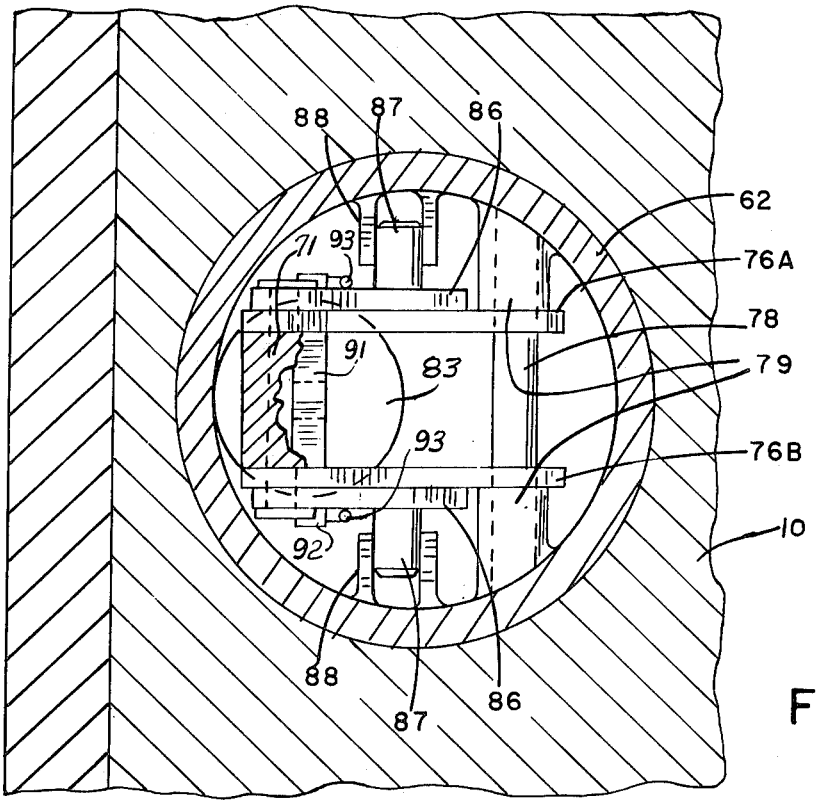
FIG. 9 is a sectional view taken as on line 9—9 in FIG. 6.

The control of the toggle linkage 70 is accomplished by a pair of control arms 86. One control arm is shown in FIG. 6, and both control arms are shown in FIG. 9. These control arms each have a pin 87 fixed thereon, each of which is slidable in a separate track 88. One track is on each side of the housing 62. The pins 87 will slide linearly along the tracks and also may rotate in the tracks. Each of the control arms 86 is pivotally connected to one of the pins 77, as shown in FIG. 9, and is held with respect thereto. Movement of the control arms 86 is guided by the tracks 88 and their respective pins 87.

Figure 7:
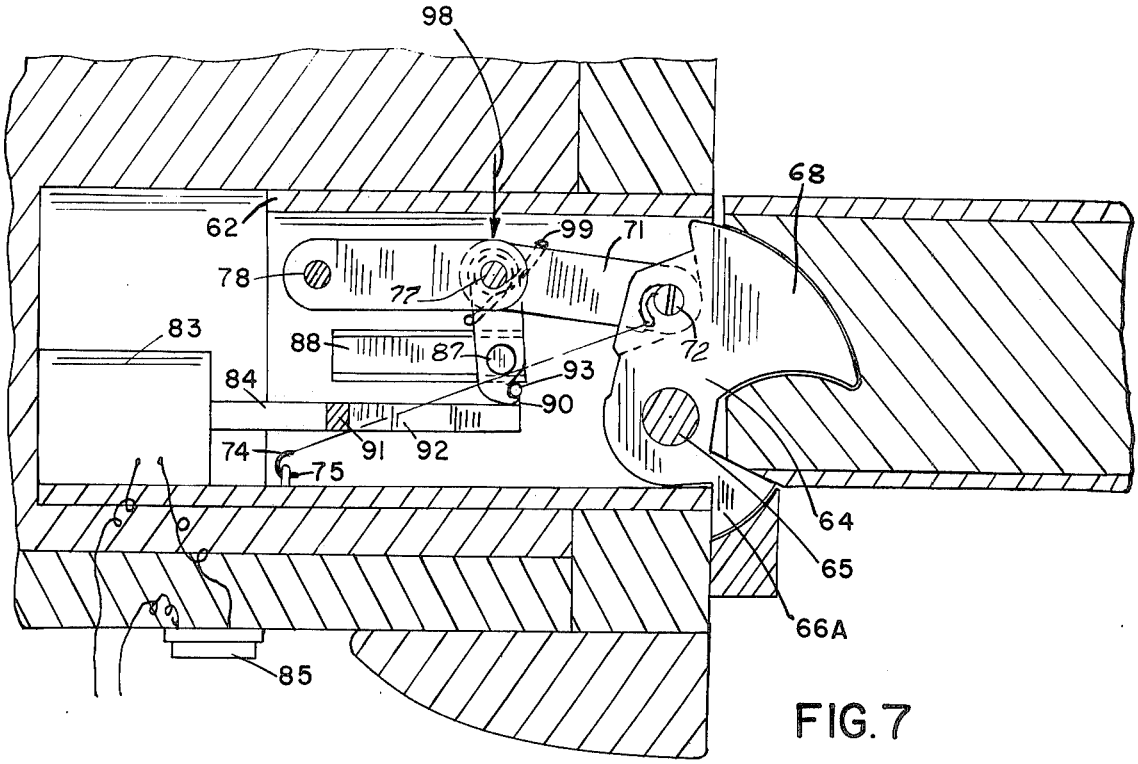
FIG. 7 is a sectional view taken along the same line as FIG. 6 showing the latch in a latched position.

The lower ends of the control arms are formed into a small hook as shown at 90 in FIG. 7. The hooks extend just below the respective tracks assembly 88 when the control arms are in position as shown in FIG. 7. The separate arms 92 formed at the end of armature 84 extend forwardly from the cross-bar 91 to run alongside and to the outside of each of the arms 86 as can perhaps be seen in FIG. 9. The side arms 92, therefore, are out of the way of the toggle linkage when it moves to a position as shown in FIG. 6. Each of the side arms 92 carries an actuator hook 93 that is positioned to engage the hooks 90 on the adjacent control arm 86 when the solenoid is in its ready position as shown in FIGS. 6 and 7 and the arms 86 are positioned, as shown in FIG. 7 also, with the toggle linkage in its locked position.

The actuator hooks 93 provide stops for the travel of arms 86. The pins 87 will be stopped positively at the end of their travel as shown in FIG. 7.

Assuming that the unit 60 is in its position shown in FIG. 6, if the door 61 is moved toward its closed position it will engage the tang 66, pivoting the latch bolt 64 about pin 65, and moving the latch bolt and toggle linkage toward its position shown in FIG. 7. This will straighten out the links 71 and 76, and at the same time will cause the arms 86 to rotate on pins 87, and also the pins 87 will slide along the tracks 88. Small torsion springs 99 which are shown only schematically, are mounted about the axis of the pin 77 and each spring loads one of the arms 86 relative to the link 71. The spring load from springs 99 tends to rotate the arms 86 in a counterclockwise direction as viewed in FIGS. 6 and 7. The torsion springs 99 tend to pivot the arms 86 about the axes of the pin 77, and when the folding linkage reaches a near center or on-center position, these torsion springs have sufficient force to slide the arms 86 and pins 87, along the respective tracks 88 to cause the arms 86 to move to a position as shown in FIG. 7. The links 71 and 76 are then in an over-center locked position as shown.

The pins 87 also go into an over-center lock position with respect to the pin 77, and it can thus be seen that any force on the linkage 70 in direction as indicated by the arrow 98 will not open the latch. The arms 86 would merely be forced more tightly against the hooks 93 and the linkage 70 will not fold. However, upon actuation of the solenoid 83, the armature 84 would retract pulling the cross-bar 91, arms 92 and hooks 93 to the left as shown in FIG. 7, to pull the hook ends 90 of the arms 86 to the left and at the same time therefore, pull the linkage to a release position. The arms 86 pull the pin 77 to release as the pins 87 slide along the tracks 88, buckling the linkage 70 and causing it to fold to a position as shown in FIG. 6, under the urging of the springs 74.

Once the arms 86 have been moved far enough so that the linkage 70 is released from its over-center or near center locked position, the force of the springs 74 acting on the latch bolt 64 will cause the latch bolt to spring open and will cause the links to fold or collapse. The arms 86 will swing or pivot around the pins 87 and the pins 87 will also slide along tracks 88. The pin 77 then will be permitted to move to position shown in FIG. 6. The hook ends 90 of arms 86 will be pivoted upwardly as shown in this figure as well.

In this form of the invention, the torsion spring 99 can be selected in a strength so that the links do not have to go over-center as shown in FIG. 7 but merely near center for locking. Similar to the operation in the previous form of the invention when the axis of pin 77 is close to an on center position (with respect to the plane defined by the axes of pins 78 and 72), spring force from spring 99 acting on arms 86 will tend to hold the linkage adjacent an on center position and any force on the lock bolt tending to open the bolt increases the friction at the linkage pivots and the linkage self locks. The linkage will be held in a locked position because of the spring pressure of spring 99 and friction. The links will not fold to an open position from an external force on the lock bolt, as when somebody tries to force the door open.

Figure 10:
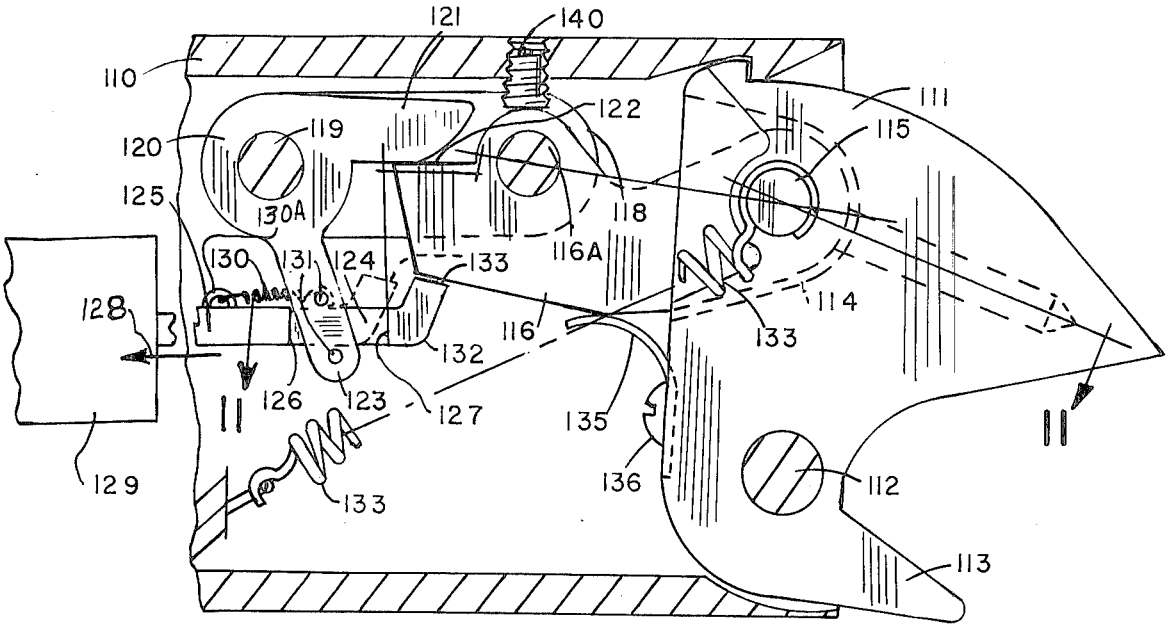
FIG. 10 is a sectional view showing fragmentarily a modified type of lock bolt and toggle linkage that may be utilized with the latches of the present invention.
Figure 11:
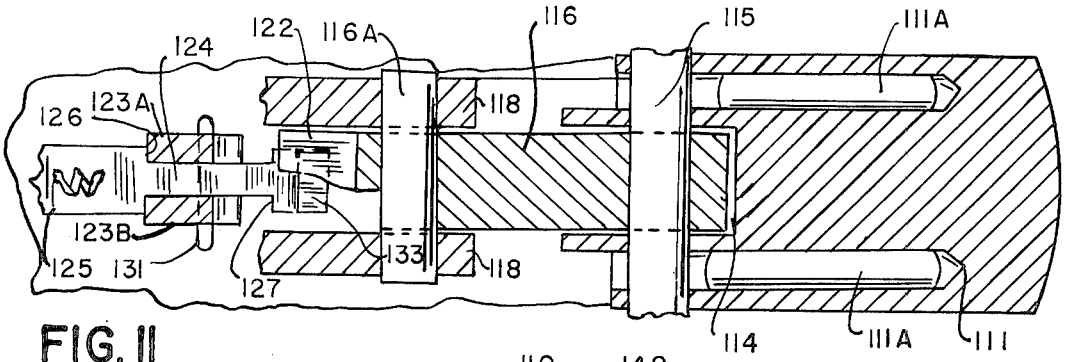
FIG. 11 is a sectional view taken as on line 11—11 in FIG. 10.
Figure 12:
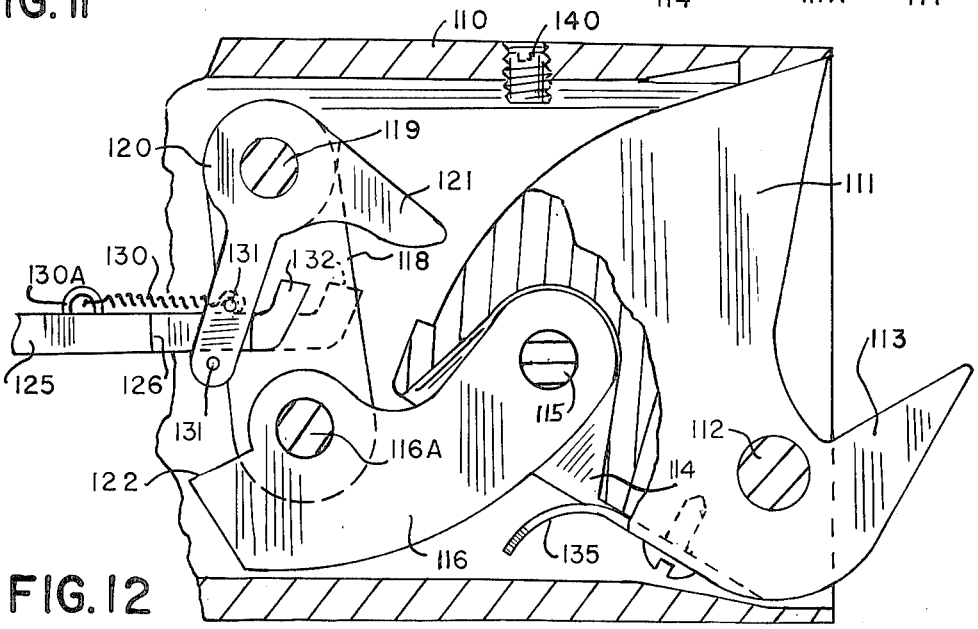
FIG. 12 is a view of the form of the invention shown in FIG. 10 showing the mechanism in a door open position.

Referring to FIGS. 10, 11 and 12, a modified form of the invention is shown in larger scale which provides for latch means for controlling a pivoting door latch. A housing 110 is made as previously explained, and many of the details of this device will be omitted because of the previous descriptions. However, the latch bolt 111 in this device is pivotally mounted onto a pin 112 that is attached to the housing 110. The latch bolt is made generally as shown before and includes a tang 113 that is engaged by the door to pivot the bolt to latched position. The latch bolt 111 has an interior recess 114 at the backside of the latch bolt. A pin 115 pivotally mounts a center link 116 to the latch bolt. This single center link 116 forms one link of a toggle linkage 117. A pair of links 118 are pivotally mounted with a pin 116A to the outer end of the link 116. The links 118 are mounted at their opposite ends from pin 116A to a pin 119 that extends across and is fixed to the housing. An actuator 120 is also pivotally mounted on the pin 119 between links 118.

The actuator 120 has an actuator end portion 121 that is positioned to overlie and engage a surface 122 at the end of the link 116 when the actuator is pivoted. When the actuator 120 is pivoted about the pin 119 in clockwise direction, it will engage a surface 122 and force the linkage 117 to a released position by moving pin 116A downwardly. The actuator 120 also has an actuator leg 123 having a slot which receives a reduced thickness portion 124 of a solenoid armature 125. The reduced portion forms shoulders 126 and 127 at opposite ends of the portion 124 which will engage the side portions 123A and 123B of the leg 123, when the armature is moved longitudinally. The solenoid armature is actuated in direction as indicated by the arrow 128 by a solenoid 129 (shown schematically) and when actuated the armature will move to the left in FIG. 10.

If the armature is not spring loaded in the solenoid, it may be spring loaded to the right, as shown, relative to leg 123 with a light spring 130 for reset purposes. The spring 130 is connected between the upper one of the pins 131 on leg 123 as shown in FIGS. 10 and 12 and a connection point 130A on the armature 125. When power to the solenoid is removed the armature will return to position with shoulder 126 against the leg 123. In this form of the invention the armature is supported on the leg 123 of the actuator with a pair of pins 131 that pass through two spaced portions 123A and 123B of the leg 123 (see FIG. 11). The armature therefore can slide relative to leg 123 for the length of the reduced portion 124. The shoulders 126 and 127 provide actuator surfaces for moving the actuator 120 as the armature is moved.

The outer end of the armature 125 is bent upwardly to form a stop lug 132 that has a stop surface which will be positioned just below the underside of the link 116 at its outer end, as shown at 133. When in the solid line position shown the linkage 117 cannot be released because downward movement of the link 116 and pin 116A is positively stopped. Any forces tending to push pin 116A down will be directly supported and resisted by stop lug 132. The downward loads on stop lug 132 are carried directly back to the lower pin 131 on leg 123 and therefore supported through actuator 120 back to pin 119.

The reduced portion 124 of the armature is of greater length than the width of leg 123. Thus the armature has lost motion between shoulders 126 and 127. When the armature is actuated by the solenoid from its position in FIG. 10, it will first move to its dotted line position shown in FIG. 10 wherein the shoulder 127 is about to contact leg 123 and the stop lug 132 has moved clear of link 116. The spring 130 is not of sufficient strength to overcome the lock force of the linkage and cause release and thus the armature will slide in leg 123 first.

Then, when shoulder 127 engages the leg 123, continued movement of the armature will pivot actuator 120 and leg 121 will push down on link 116, near pin 116A and release the linkage as previously described. The actuator leg 121 engages the folding linkage 117 between its extreme end pins 115 and 119 to provide a mechanical movement of the linkage to release position through the pivoting actuator 120. The latch dog is spring loaded with springs 133 (shown only fragmentarily) to open position, once released, as before.

When the solenoid 129 is relaxed, return spring 130 will pull the armature until shoulder 126 is against actuator as shown in dotted lines in FIG. 12. However, the actuator 120 will not be returned to its original position but remains as shown in dotted lines at 132 in FIG. 12 until the door is again closed.

Then, when the door is again closed, the latch bolt will pivot closed and as the links 116 and 118 reset the actuator 120 they pull the armature to its solid line position in FIG. 10. It should be noted that the stop lug 132 will be spaced from link 116 until the final reset movement which causes leg 123 to lift the armature slightly and move lug 132 adjacent the underside of the link 116.

The stop lug 132 prevents release of the linkage 117 from external pressures unless the solenoid is energized to pull the stop lug away from its latched position. The armature and actuator provide a lost motion linkage. The armature must move to unlock the linkage before the actuator is moved.

The latch bolt has a pair of hardened pins 111A inserted in the latch bolt to prevent sawing through the latch bolt to gain entry. An adjustable stop screw 140 is threadably mounted in the housing in position to engage link 116 and stop the pin 116A in its desired position as the linkage locks.

It should be noted that a leaf spring 135 is also provided, and is fastened with a suitable screw 136 to the backside of the latch bolt 111 and urges the link 116 in a clockwise direction about pin 115 when the bolt approaches closed position. This spring exerts a resilient force on the linkage when the unit is in its position shown in FIG. 10 so that the pins 115, 116A and 119 do not have to go beyond center for locking even though they are shown over-center. The spring 135 exerts a resilient force, urging the linkage to its latched position shown in FIG. 10 as the door closes. If the linkage is stopped against the adjustable stop screw 140 before reaching an on-center position, but is near center, the pressure of spring 135 plus the increasing friction at the pins 115, 116A and 119 will increase holding force more rapidly than any force applied to bolt 111 tending to release the linkage. The unit will thus be held securely from external forces.

The latch bolt in all forms of the invention is openable even under pressures developed by warped doors, or panic pressures as might occur in a fire or explosion.

The latch device of the present invention is similar to a trigger actuated device. The linear solenoid acts through suitable mechanism to pull the links directly until they release. Then the latch bolt will snap open from the load of the springs between the latch bolt and the housing which tends to pivot the latch bolt open.

It should also be noted that the unit can be key lock operated. For example in the form shown in FIGS. 10, 11 and 12, a key lock can be used for moving the linearly movable armature merely by providing a crank arm arrangement on a rotary key lock with a connecting line or cable to cause linear movement of the armature.

The recesses 24 and 67 of latch bolts 21 and 64 are shaped so that finger portions 25 and 68 form hooks that, when fitted into receptacles in the door, will resist separating of the door and the door jamb. The hooks will not slide out of the door receptacles if a burglar tries to pry the door away from the jamb.

What is claimed is:

1. A door lock device for use with a door frame member and movable door member comprising a housing mountable in one of said members, the other of said members having a receptacle in an edge adjacent said lock device, a latch bolt pivotally mounted to said housing about a generally upright axis when installed, said latch bolt being pivotally movable from a retracted position to a locked position, means associated with said latch bolt operable to cause pivoting of said latch bolt as a door to be latched is moved toward a closed position whereby portions of said latch bolt protrude from said housing and into the receptacle in said other member, an elongated tension coil spring means having one end connected to said housing and the other end connected to said latch bolt and urging said latch bolt to retracted position, toggle linkage means mounted inside said housing including a first link pivotally mounted to said latch bolt at a position spaced from the pivot between said latch bolt and said housing and a second link, pivot means pivotally mounting said second link to said first link at an opposite end of said first link from the pivot mounting to said latch bolt, and said second link also being pivotally mounted to said housing at an opposite end thereof from its pivotal mounting to said first link, said toggle linkage means being in a folded position when said latch bolt is in an unlatched position, and moving to a locked position wherein the pivot axis formed by the pivot means between the first and second links is generally adjacent to a plane defined by the pivots between the first link and the latch bolt and the second link and the housing to resist pivoting of said latch bolt from its latched to its unlatched position from loads on the latch bolt, and actuator means including an actuator member movable from a first position to a second position, and to exert a mechanical force on said toggle linkage means at a location between the pivot of the second link to the housing and the pivot of the first link to the latch bolt when the linkage is in locked position and to mechanically move said toggle linkage means toward folded position and permit the latch bolt to move to unlatched position.

2. The combination as specified in claim 1 wherein said actuator means comprises an electrically movable linear actuator, and means connecting said linear actuator of said solenoid to said actuator member to cause said actuator member to move independently of said toggle linkage means.

3. The combination as specified in claim 2 wherein said actuator member comprises a pivoting bell crank pivotally mounted on substantially the same axis as the pivot of the second link to the housing, said bell crank having an actuator leg engaging one of said links to positively move the pivot means between the first and second links toward a folded position upon linear actuation of said solenoid.

4. The combination as specified in claim 1 wherein said actuator means includes a movable control member, lost motion connection means connecting said movable control member to said actuator member to control movement thereof betwen said first and second positions, means supporting said movable control member in position to support said toggle linkage means to prevent folding of said toggle linkage means when the actuator member is in its first position, said lost motion connection means permitting said movable control member to move to position where it does not support said toggle linkage means prior to moving said actuator member as said control member of said actuator means is actuated to move the actuator member from its first to its second position.

5. The combination as specified in claim 1 and adjustable stop means to engage said toggle linkage means to adjust the position of the pivot means between the first and second links relative to the plane passing through the pivots between said first link and said latch bolt and the second link and said housing when said latch bolt is in its latched position.

6. The combination as specified in claim 1 wherein said actuator member comprises a actuator lever having a first end pivotally connected to said toggle linkage means, a track in said housing, a second end of said actuator lever being pivotally mounted and slidably translatable in said track and said actuator means including a member to engage a portion of said actuator lever and translate said actuator lever along said track and to tend to pivot said actuator lever whereby said lever pulls the toggle linkage means toward a folded position.

7. The combination as specified in claim 1 wherein said first link comprises a solid link, and said second link comprises two leg members on opposite sides of said solid link, and said actuator member comprises a bell crank pivotally mounted between said leg members, said bell crank having a first portion which engages a portion of said first link adjacent the pivot means as the actuactor means is actuated.

8. The combination as specified in claim 1 wherein the axis of said pivot means between said first and second link approaches but does not pass through the plane defined by the pivot axis between said first link and said latch bolt and the pivot axis between said second link and said housing as the latch bolt moves to latched position, and a second spring mounted on the lock device acting to urge said pivot means between said first and second links toward said plane as the latch bolt moves to latched position and wherein said pivot means is moved sufficiently close to said plane to self-lock under pressure of said first spring to prevent the latch bolt from moving to open position from external opening force being applied to said latch bolt.

9. The combination as specified in claim 1 wherein said means on said latch bolt protruding from said frame includes a tang portion protruding to position to engage said other means as the door is closed, and said latch bolt includes a finger portion spaced from said tang portion by a recess defined in said latch bolt, said door having a mating recess for receiving said finger portion as the latch bolt moves to latched position.

10. A door lock device for a door comprising a housing, a latch bolt pivotally mounted to said housing about a first axis when installed, said latch bolt being movable about said first axis from a retracted position to a locked position, means cooperating between said lock device and a door with which it is to be used to cause pivoting of said latch bolt to latched position as said door is moved toward a closed position, toggle linkage means mounted inside said housing including a first link pivotally mounted to said latch bolt about a second axis positioned spaced from the first axis, and a second link pivotally mounted about a third axis to said first link adjacent an opposite end of said first link from said second axis, and said second link also being pivotally mounted to said housing about a fourth axis at an opposite end thereof from the third axis, said pivotal mounting between said first and second link being unconnected to said housing, said toggle linkage means being in a folded position when said latch bolt is in an unlatched position, and movable to a position wherein the third axis is in locked position adjacent a plane defined by the second and fourth axes to resist the pivoting of said latch bolt from its latched to its unlatched position from external forces on said latch bolt, spring means connected between said latch bolt and said housing tending to pivot said latch bolt towards its unlatched position, and actuator means including an actuator member mounted on said housing and mechanically engaging said toggle linkage means at a location between the second and fourth axes and being movable to a release position wherein the actuator member forces said third axis mechanically away from said plane a sufficient distance to permit said toggle linkage means to fold and to permit said spring means to move said latch bolt to unlatched position against resistance of movement of said door.

11. The combination as specified in claim 10 wherein said actuator means includes a linearly movable plunger, and means connecting said linearly movable member to said actuator member, so that upon movement of said linearly movable member to a first position said actuator member permits said toggle linkage to move to position with the latch bolt in latched position, and movable to a second position whereby the actuator member is moved to engage the toggle linkage and unlatch the latch bolt, said linearly movable member being adjacent the toggle linkage and in position to retain the toggle linkage from folding movement when the linearly movable member is in first position, said means connecting including lost motion connection means to permit the linearly movable member to move away from its first position to clear the toggle linkage movement before the actuator member is moved to release the toggle linkage as the linearly movable member is moved from its first position toward its second position.

12. The combination of claim 10 wherein said latch bolt has a recess defining an outer end finger portion to fit within a receptacle provided in a door with which the door lock device is used, said finger portion forming a hook resisting separation of the latch bolt and a door which the latch bolt engages when latched in direction parallel to the plane of the door.

13. A door latch device comprising a housing, a latch bolt mounted in said housing and movable from a retracted position to a locked position, toggle linkage means mounted inside said housing for controlling movement of said latch bolt including a first link pivotally mounted to said latch bolt and a second link, pivot means pivotally mounting said second link to said first link at an opposite end of said first link from the pivot mounting to said latch bolt, means to mount said second link to said housing at an opposite end of the second link from its pivotal mounting to said first link, said toggle linkage means being in a folded position when said latch bolt is in an unlatched position, and moving to a locked position with said latch bolt in latched position, actuator means connected to said toggle linkage means for moving said toggle linkage to folded position, said actuator means including a member mechanically supporting the toggle linkage means in its locked position to prevent folding movement, said actuator means first moving said member away from position supporting said toggle linkage means when the actuator means is actuated to fold said toggle linkage means.

14. The combination as specified in claim 13 wherein said actuator means includes a movable control member comprising said member mechanically supporting said toggle linkage means, lost motion connection means connecting said movable control member to other portions of said actuator means to control movement of said other portion between first and second positions, means supporting said movable control member in position to support said toggle linkage means to prevent folding of said toggle linkage means when the other portions are in the first position, said lost motion connection means permitting said movable control member to move to position where it does not support said toggle linkage means prior to moving said other portions as said control member is moved to fold the toggle linkage means.

* * * * *